US007866070B2

(12) United States Patent
Beyer, Jr.

(10) Patent No.: US 7,866,070 B2
(45) Date of Patent: Jan. 11, 2011

(54) APPARATUS FOR HOLDING CALENDAR

(76) Inventor: Charles Edward Beyer, Jr., 2615 N. 4th St., Columbus, OH (US) 43202

( * ) Notice: Subject to any disclaimer, the term of this patent is extended or adjusted under 35 U.S.C. 154(b) by 396 days.

(21) Appl. No.: 12/135,163

(22) Filed: Jun. 7, 2008

(65) Prior Publication Data

US 2008/0308702 A1 Dec. 18, 2008

Related U.S. Application Data

(60) Provisional application No. 60/944,239, filed on Jun. 15, 2007.

(51) Int. Cl.
*G09D 3/00* (2006.01)

(52) U.S. Cl. ..... 40/107; 40/647; 24/303

(58) Field of Classification Search ..... 40/107, 40/658, 647; 24/303; 223/96
See application file for complete search history.

(56) References Cited

U.S. PATENT DOCUMENTS

| | | | | |
|---|---|---|---|---|
| 2,774,161 | A * | 12/1956 | Dixon | 40/107 |
| 4,085,848 | A | 4/1978 | Tsuge | |
| 4,105,127 | A | 8/1978 | Holl | |
| 4,629,075 | A | 12/1986 | Hutten | |
| 4,776,549 | A | 10/1988 | Anastos | |
| 4,830,322 | A | 5/1989 | Gary | |
| 4,899,974 | A | 2/1990 | Wear | |
| 4,976,055 | A | 12/1990 | Kane | |
| 5,096,069 | A | 3/1992 | Brandon | |
| 5,711,430 | A | 1/1998 | Andersen | |
| 6,158,597 | A | 12/2000 | Mcdermott | |
| 6,182,938 | B1 | 2/2001 | Wright | |
| 6,345,456 | B1 | 2/2002 | Bracken | |
| 6,574,894 | B1 | 6/2003 | Hamilton | |
| 6,921,073 | B2 * | 7/2005 | Chabot et al. | 273/269 |
| 2004/0111928 | A1 * | 6/2004 | Gavronsky | 40/107 |

OTHER PUBLICATIONS

Calendars.com, Susan Winget Heart and Home Calendar Hanger, from Gaylord design Corp. at <http://www.calendars.com/xq/asp/TID> (printed Sep. 13, 2006).
Calendars.com, Wrought Iron Calendar Frame, from Avalanche at <http://www.calendars.com/xq/asp/TID> (printed Sep. 13, 2006).
Calendars.com, Maple Calendar Keeper, from Amcal at <http://www.calendars.com/xq/asp/TID> (printed Sep. 13, 2006).

* cited by examiner

*Primary Examiner*—Gary C Hoge
(74) *Attorney, Agent, or Firm*—Ronald J. Koch

(57) ABSTRACT

An apparatus for holding a calendar comprises: a back plate 4; a hinged bracket 5 being hingedly connected to the back plate; a receiving plate 15 being fixedly attached to the hinged bracket and having a horizontally oriented slot 16; means for releasably closing the back plate and hinged bracket assembly; and means for attaching the back plate to a vertical surface.

20 Claims, 7 Drawing Sheets

APPARATUS FOR HOLDING CALENDAR

The present application is related to the provisional patent application No. 60/944,239 of Charles Edward Beyer Jr., Columbus, Ohio filed Jun. 15, 2007, entitled "Improved System for holding Calendar", and based on which priority is herewith claimed under 35 U.S.C. 119(e) and the disclosure of which is incorporated herein by reference in its entirety as if fully rewritten herein.

BACKGROUND AND SUMMARY

The present invention relates generally to calendars and specifically to systems and methods for hanging or holding calendars.

Figure 1:
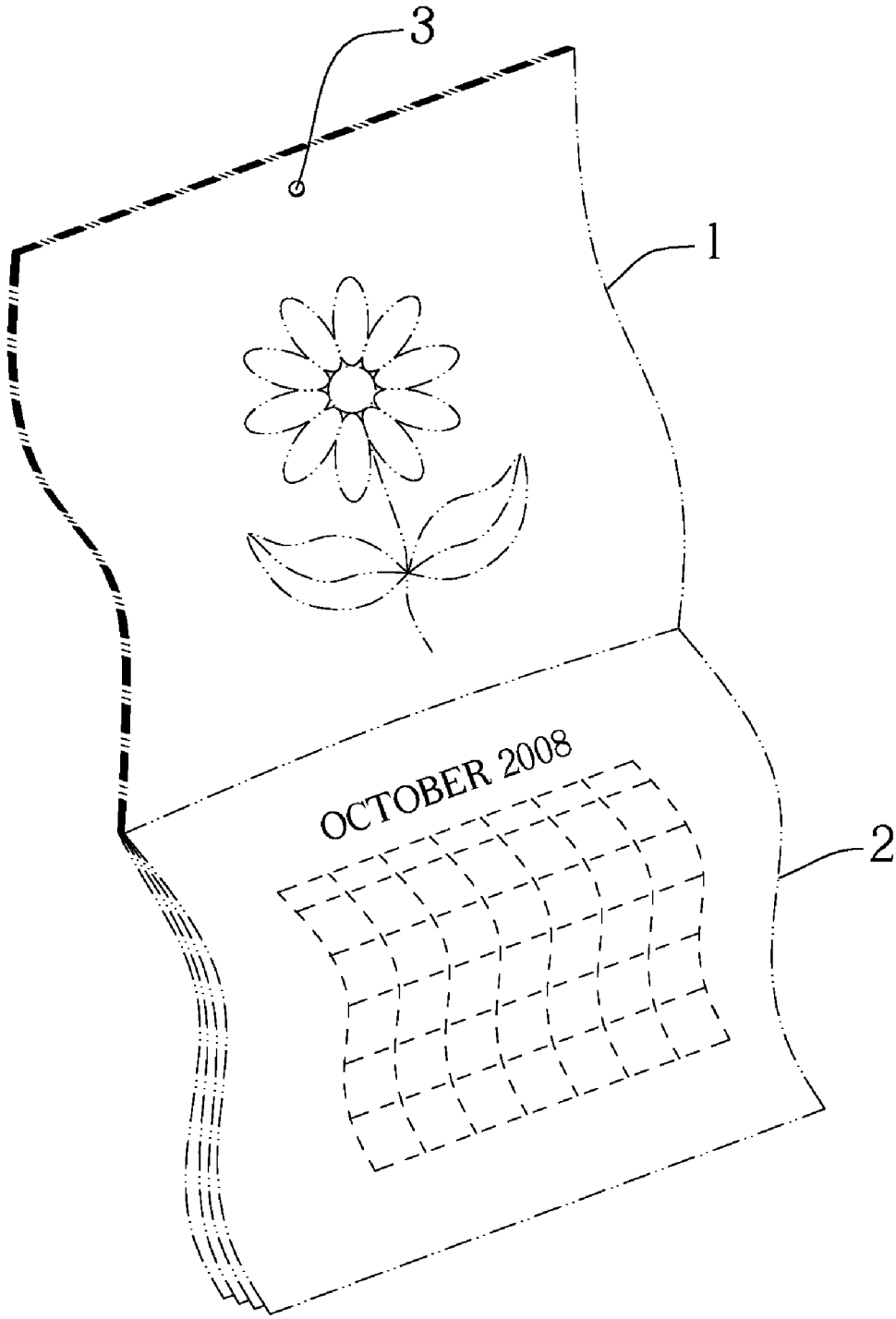
FIG. 1 PRIOR ART
FIG. 1 depicts a perspective view of a typical calendar

Multi-page calendars and holders thereof are known in the art. As shown in FIG. 1, a typical multi-page calendar ("calendar" herein) has a lower portion 2 for displaying date information, an upper portion 1 for displaying pictures, and an aperture 3 (displaced on every page) for hanging the calendar. Obviously, each page has date information on one side and a display area on the reverse side.

Conventional methods for hanging these calendars are problematic. A common method is to use tacks, or thumbpins inserted in a wall. These have to be repeatedly removed and re-inserted every month to turn the pages of the calendar. Additionally, some users repeat the process many times each day to enter appointments and reminders, etc. Eventually, the pins lose the ability to stay in the wall because the hole has become larger. Accordingly, various systems for holding calendars have been developed.

However, none of the prior art, alone or in combination, teach a system for hanging calendars comprising a hinged bracket with wall anchoring means and magnets to hold the bracket shut as it grips a calendar and means for interchangeable displays fastened to the hinged bracket. Additionally, the present invention obviates the need for the aperture pin arrangement. The calendar is held in place by magnets, so the pin is unnecessary. The present invention is also advantageous in that it can hold items other than calendars. For example, pictures, notepads, and hand towels, to name a few.

DETAILED DESCRIPTION

Figure 2:
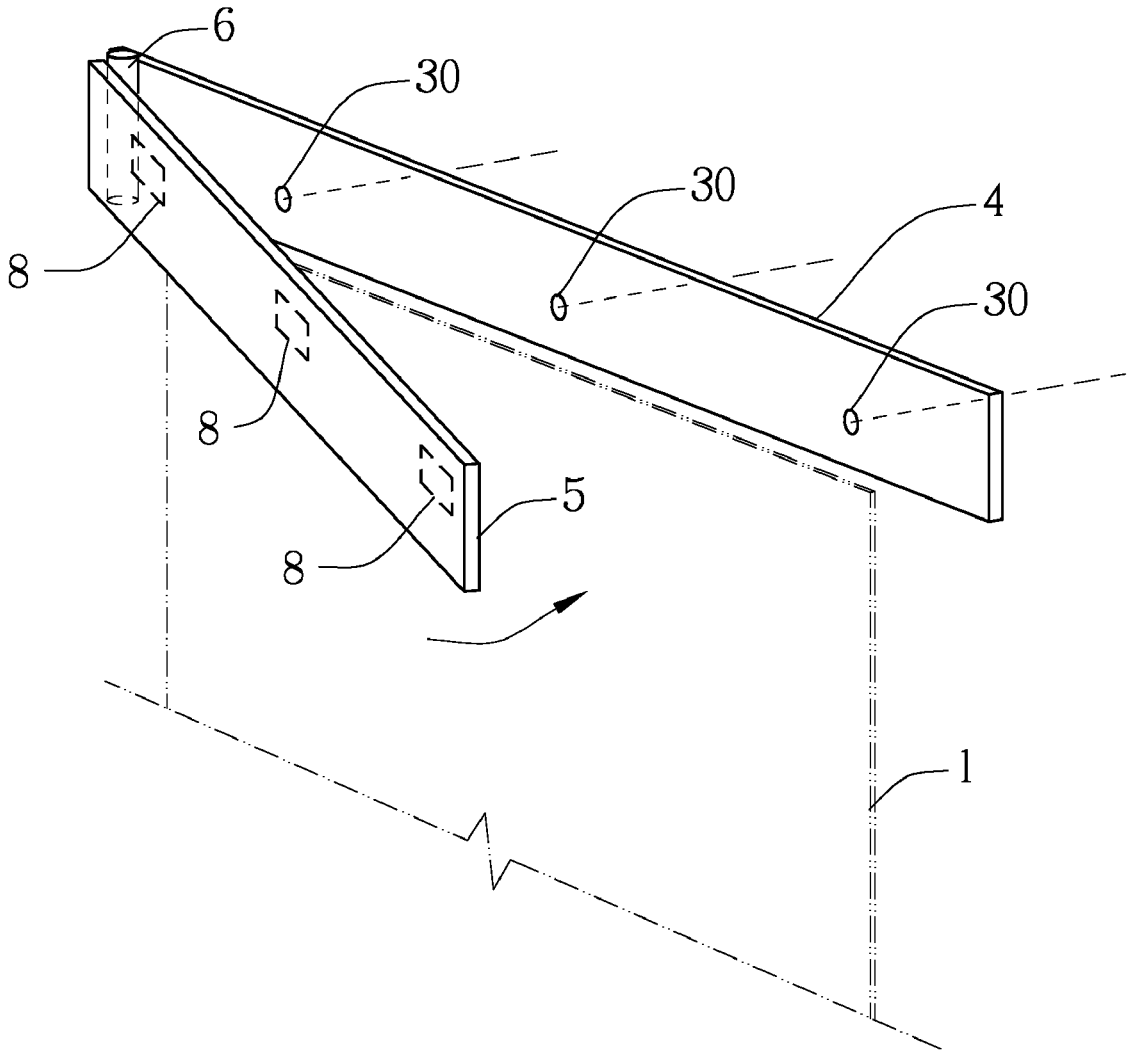
FIG. 2 depicts a perspective view of the back plate and hinged bracket in one embodiment

One embodiment (FIG. 2) of the present invention comprises back plate 4, hinged bracket 5, magnets 8 (to secure hinged bracket 5 to back plate 4), hinge 6, and means for holding the apparatus to a wall. Back plate 4 and hinged bracket 5 are elongate planar, and rigid plates, of substantially rectangular shape.

In one embodiment, the means for holding the apparatus to a wall comprises one or more holes 30 displaced in back plate 4 wherein screws, drywall anchors, nails (or other similar fasteners) may be used in conjunction with a wall suitable for anchoring in this fashion.

Hinged bracket 5 is hingedly secured to back plate 4. Back plate 4 has a metallic portion to coincide with magnets 8. As will be apparent, the entire back plate can be metallic or otherwise have metallic portions to correspond to the magnets. The magnets 8 must be of sufficient strength to hold a calendar in place as hinged bracket 5 is secured to back plate 4.

One embodiment (FIGS. 4 through 6) comprises a decorative theme plate 13, and means for removably attaching theme plate 13 to hinged bracket 5. This facilitates providing myriad theme plates that can be selectively interchanged without having to move the calendar and apparatus. The user may freely interchange decorative theme plates 13 (having front display surface 11) without interfering with the calendar.

Theme plate 13 is preferably elongate planar, and rigid. Front display surface 11 serves primarily as means for displaying designs, graphics, or other flat or contoured designs.

Figure 4:
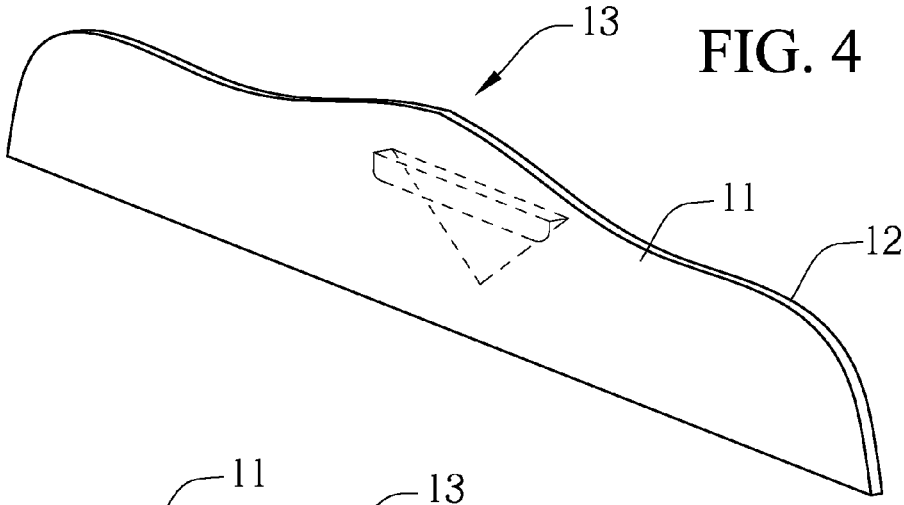
FIG. 4 depicts a perspective view of the decorative theme plate in one embodiment
Figure 5:
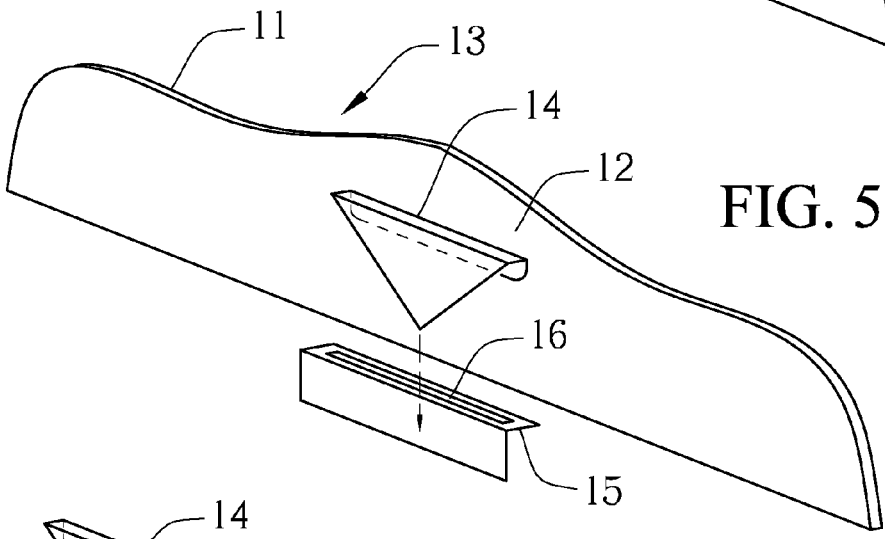
FIG. 5 depicts a perspective view of the decorative theme plate in one embodiment
Figure 6:
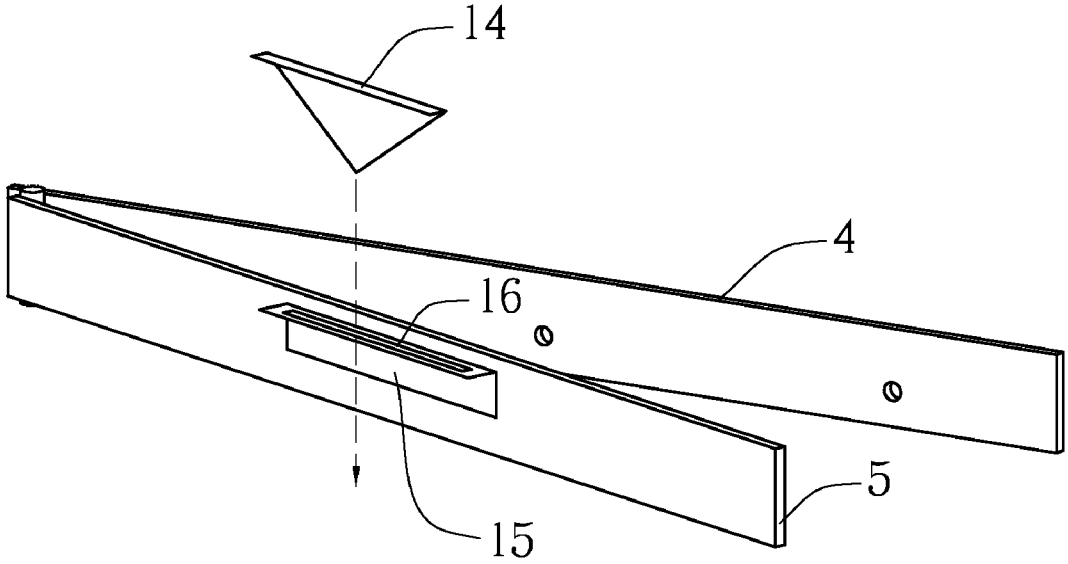
FIG. 6 depicts a perspective view of the back plate and hinged bracket in one embodiment

As depicted in FIGS. 4 & 5, plate 13 has a flattened bottom portion and curved side and top portions. This shape is not essential. As will be apparent, other shapes (e.g. rectangular or ovoid) shapes can be used.

One embodiment (not shown) comprises theme plate having a perforated surface. This surface is useful in the various arts and crafts in that plants, flowers, and other thin bodies can be inserted into the holes. Other uses of the holes will be apparent to those of skill in the art. As will also be apparent to those of skill in the art, the holes sizes can be non uniform and varied to suit the particular application.

Various means for affixing theme plate 13 to hinged bracket 5 may be used. One embodiment comprises tab 14 affixed to the back 12 of theme plate 13. Tab 14 is adapted to fit within opening 16 in receiving plate 15 which is secured to hinged bracket 5. Plate 15 and tab 14 may be secured by use of fasteners, glue, epoxy, welding or other suitable means, or may also be fabricated as an integral part of either bracket 5 or theme plate 13, respectively.

Back plate 4, hinged bracket 5, and theme plate 13 may be made of metal, wood, plastic, or other material having similar structural characteristics.

Tab 14 is adapted so as to be downwardly wedge shaped. Thereby, an advantage is achieved because the wedge shape causes theme plate 13 to be self aligning horizontally as it is seated on plate 15.

Figure 5A:
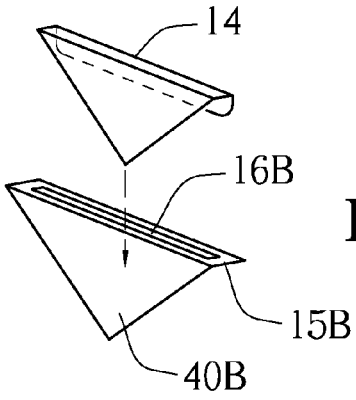
FIG. 5A depicts a perspective view of the receiving plate in one embodiment

In one embodiment (FIG. 5A), receiving plate 15B is adapted to a sheath-like use wherein tab 14 may be inserted. The sheath is formed by a vertical portion 40B having a downwardly directed wedge shape. Tab 14 is restrained (while it is inserted within opening 16B) by vertical portion 40B. An advantage is thereby achieved because theme plate 13 is prevented from rocking inwardly and outwardly with respect to a vertical plane.

Figure 7:
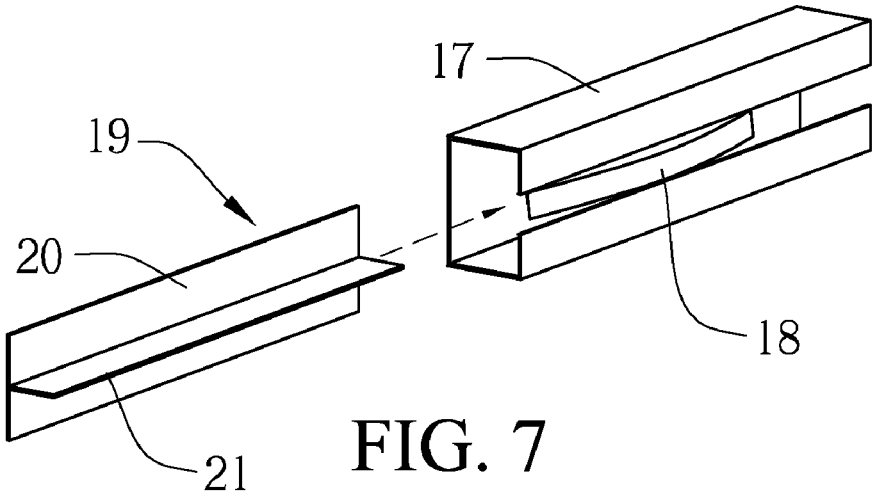
FIG. 7 depicts a perspective view of the mounting plate in one embodiment
Figure 8:
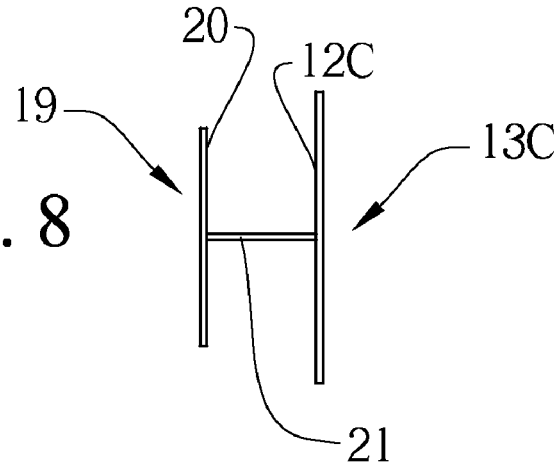
FIG. 8 depicts a side view of the mounting plate in one embodiment

One embodiment (FIGS. 7,8) for affixing theme plate 13C to a hinged bracket comprises c-channel 17 having arcuate spring 18 displaced therein, and mounting plate 19 having flange 21 and vertical portion 20. Mounting plate 19 is affixed to back 12C of theme plate 13C by fixedly securing one edge of flange 21 to back 12C. The opposite edge of flange 21 is fixedly secured to vertical portion 20.

Mounting plate 19 slidingly engages c-channel 17. Upon insertion, spring 18 presses against vertical portion 20 and thereby holds mounting plate 19 fixed. Flange 21 (or mounting plate 19) may be secured to theme plate 13C by use of fasteners, glue, epoxy, welding or other suitable means, or may also be fabricated as an integral part of theme plate 13C.

As will be apparent, other means of holding theme plate 13 to hinged bracket 5 may be used such as magnets and velcro (trademark). Additionally, various means for holding the apparatus to walls or other surfaces (e.g. metallic surfaces such as refrigerators) may be employed. For example, screws, tape, Velcro (trademark), suction cups, and magnets.

Figure 3:
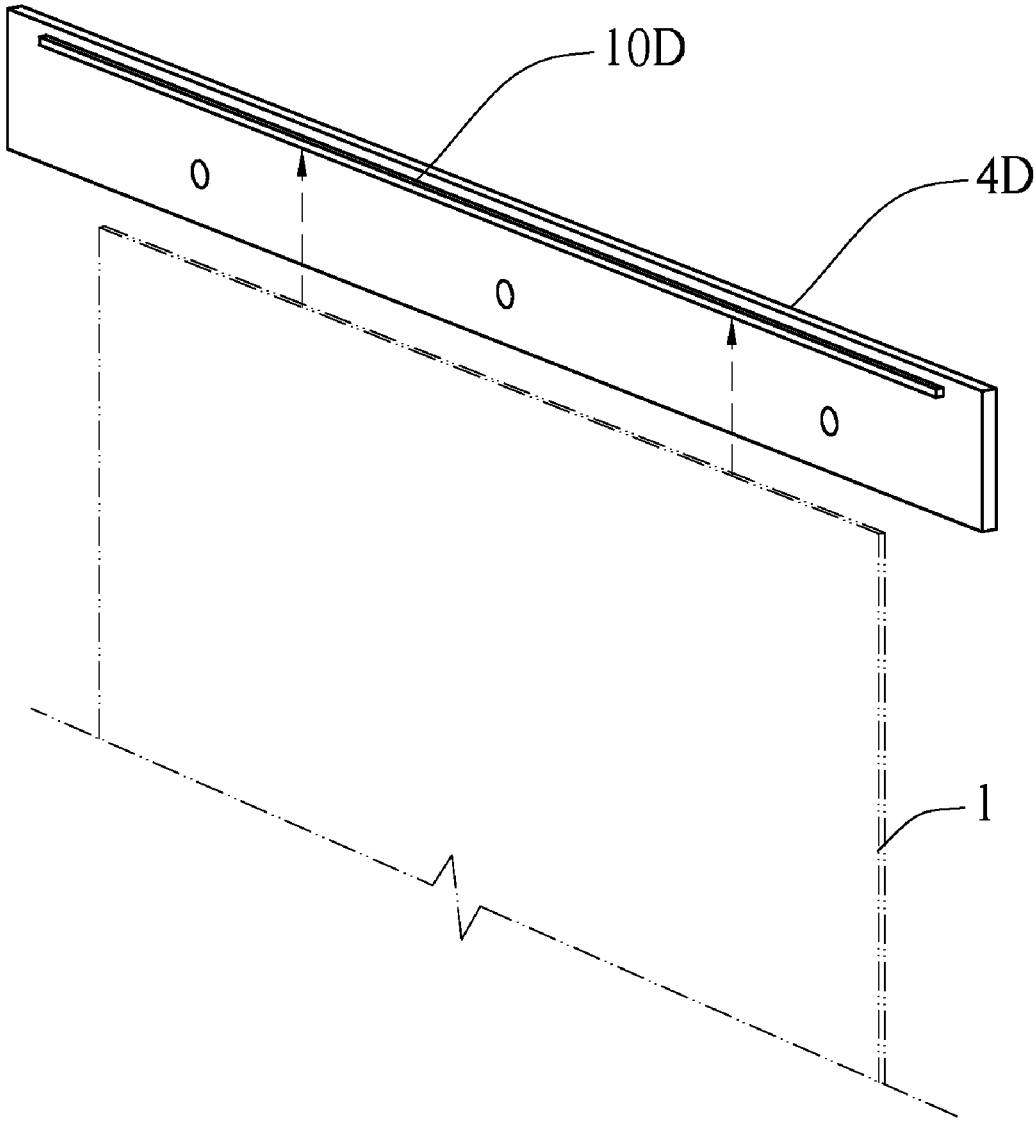
FIG. 3 depicts a perspective view of the back plate in one embodiment

One embodiment (FIG. 3) comprises ridge 10D, affixed to back plate 4D. Ridge 10D facilitates alignment of a calendar as the top edge thereof is abutted against it. In operation, the user places a calendar against ridge 10D, closes hinged bracket 5 (not shown) to hold the calendar in place.

Figure 9:
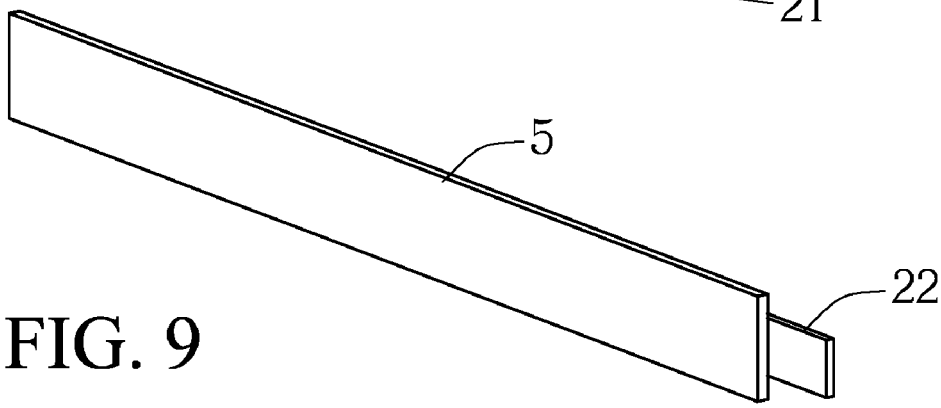
FIG. 9 depicts a perspective view of the back plate with finger tab in one embodiment

One embodiment (FIG. 9) comprises finger tab 22 attached to the non-hinged end of hinged bracket 5. Tab 22 facilitates opening and closing of the assembly. The user simply opens the apparatus by placing a finger against finger tab 22, changes the calendar to the next month, and re-closes the apparatus.

As will be apparent, various means of hinged connection may be used. For example, a common hinge or flexible material such as thin metal or plastic may be used.

Figure 10:
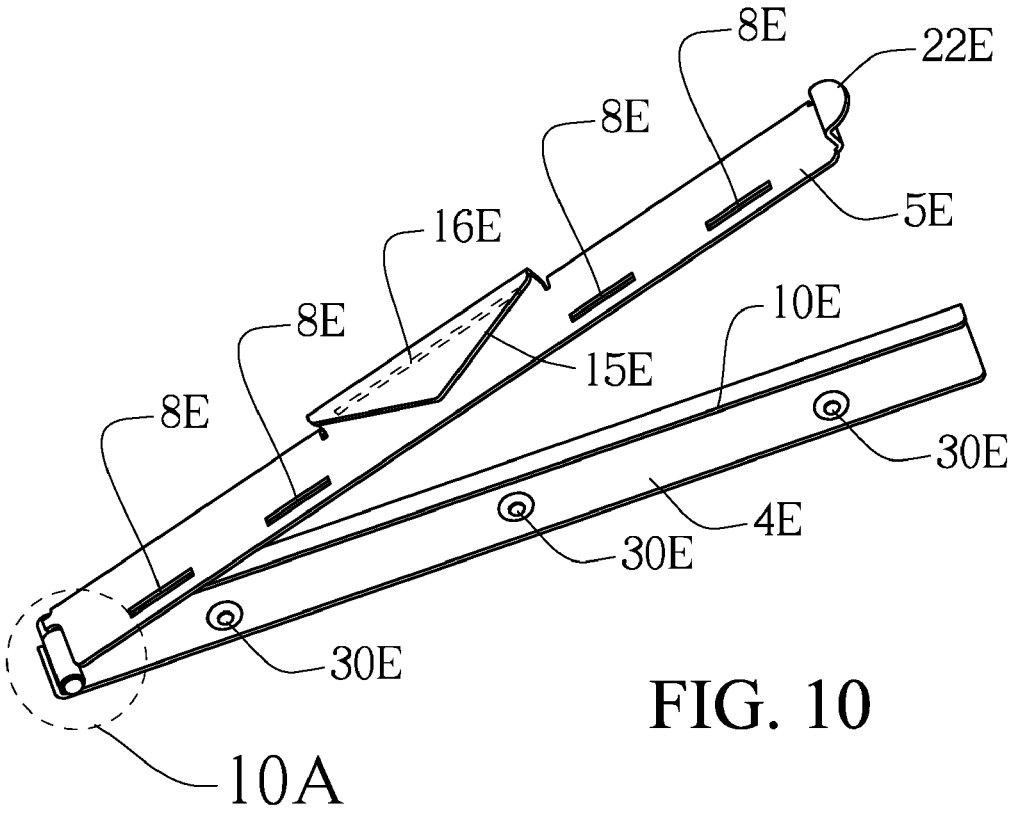
FIG. 10 depicts a perspective view of the back plate and hinged bracket in one embodiment
Figure 10A:
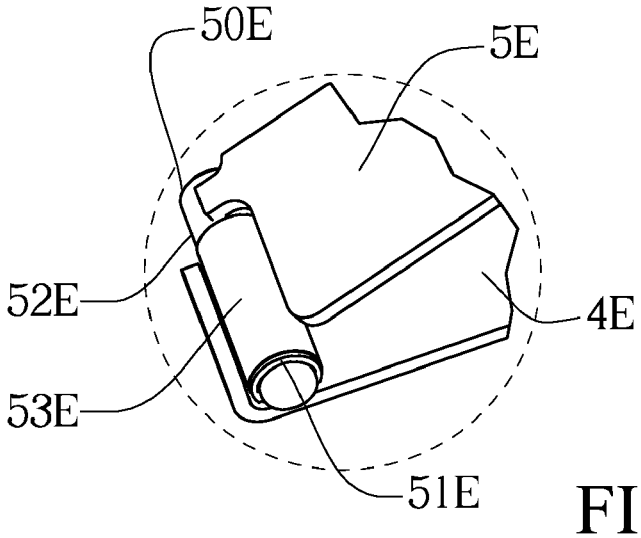
FIG. 10A depicts an enlarged view of the back plate and hinged bracket in one embodiment

In one embodiment (FIGS. 10, 10A), hinged bracket 5E is hingedly secured to back plate 4E using hinge pin 50E with clip 51E.

Hinge pin 50E has a shoulder 52E (comprising the upper portion of the pin) for limiting movement in one direction while clip 51E (fitting in a groove around the lower end of pin 50E) prevents movement in the other direction.

Hinged bracket 5E is fixedly secured to shoulder 52E. Sleeve 53E is fixedly secured to back plate 4E. Pin 50E is inserted through sleeve 53E. Clip 51E is then secured to hold the assembly in place.

Channel 10E is affixed to the upper portion of back plate 4E. Channel 10E facilitates alignment of a calendar as the top edge thereof is inserted within it. Channel 10E is c-shaped in cross section creating a channel of approximately 0.25 inches. This dimension is not exclusive in that is must be of sufficient dimension to allow insertion of a calendar.

Channel 10E may be secured to plate 4E by use of fasteners, glue, epoxy, welding or other suitable means, or may also be fabricated as an integral part of plate 4E.

Hinged bracket 5E is adapted to engage a theme plate (e.g. FIGS. 4 & 5). Receiving plate 15E is secured to hinged bracket 5E. Opening 16E is adapted to accommodate a tab (e.g. tab 14 in FIGS. 4 & 5). Receiving plate 15E is adapted to form sheath-like means similar to 40B in FIG. 5A. Magnets 8E are affixed to hinged bracket 5E so as to releasably engage back plate 4E. Holes 30E are displaced in back plate 4E wherein screws, drywall anchors, nails (or other similar fasteners) may be used to affix the apparatus to a wall.

Other methods of attaching the back plate to various vertical surfaces are possible. The invention is well suited for use in office cubicles and refrigerators. In these examples, holes 30 (as well as holes described in other embodiments) are not used to anchor the back plate to a wall. Instead, the back plate is adapted to attach to the desired surface. The back plate can either connect to a separate adapter (via holes 30, or other means of secure attachment) or alternatively can have the appropriate connecting means integrated into the back plate.

For an office cubicle, a c-shaped bracket is used to connect to the upper surface of the wall of a cubicle. Thus, the invention is hung instead of anchored. One of skill in the art would appreciate the design of conventional office cubicles as well as the myriad means of hanging from the walls thereof. For a refrigerator, a magnet means is utilized to secure the invention to a refrigerator by either magnets integrated into the back plate or alternatively providing a separate adapter with magnets.

One of skill in the art will appreciate that various magnet arrangements can be used. The magnets must be of sufficient strength to hold a calendar in place as the hinged bracket is secured to the back plate. One embodiment comprises using magnets that can extend inwardly and outwardly from the hinged bracket. This is advantageous in that the magnet can self adjust to calendars of varying thickness. For instance, in the month of January, only one page is held in place by the magnets and the other pages hang down. Conversely, in the month of December, all pages but one are held in place by the magnets. Thus, the variance allows the magnet to extend outwardly to engage the only one page (in January) and gradually inwardly towards the hinged bracket in later months.

One embodiment comprises using a magnet enclosed within a flexible holder similar in fashion to a refrigerator gasket. Other embodiments comprise convoluted gaskets, accordion-like gaskets, and the like.

What is claimed is:

1. An apparatus for holding a calendar comprising:

a back plate;

a hinged bracket being hingedly connected to the back plate;

a receiving plate being fixedly attached to the hinged bracket and having a horizontally oriented slot;

means for releasably closing the back plate and hinged bracket assembly;

means for attaching the back plate to a vertical surface.

2. The apparatus of claim 1 wherein the means for releasably closing the back plate and hinged bracket assembly further comprises:

the hinged bracket having at least one magnet attached thereto, the magnet being adapted to releasably engage the back plate, the back plate having a metallic portion to coincide with the at least one magnet.

3. The apparatus of claim 1 wherein the means for releasably closing the back plate and hinged bracket assembly further comprises:

the hinged bracket having at least one magnet attached thereto, the magnet being adapted to releasably engage the back plate, the back plate being entirely metallic.

4. The apparatus of claim 1 wherein the means for attaching the back plate to a vertical surface comprises:

one or more holes displaced in the back plate wherein screws, drywall anchors, nails, or other similar fasteners may be used to affix the back plate to a wall.

5. The apparatus of claim 1 wherein the means for attaching the back plate to a vertical surface comprises:

an adapter having a c-shaped portion to engage the top edge of a wall of an office cubicle.

6. The apparatus of claim 5 further comprising:

the back plate being releasably attached to the adapter.

7. The apparatus of claim 5 further comprising:

the adapter being integrated into the back plate.

8. The apparatus of claim 1 wherein the means for attaching the back plate to a vertical surface comprises:

an adapter having at least one magnet for releasably engaging a metallic surface.

9. The apparatus of claim 8 further comprising:

the back plate being releasably attached to the adapter.

10. The apparatus of claim 8 further comprising:

the adapter being integrated into the back plate.

11. The apparatus of claim 1 further comprising:

the back plate having a ridge being horizontally oriented near the top of the back plate;

whereby the top edge of a calendar may be abutted against the ridge to properly align it.

12. The apparatus of claim 1 further comprising:

the hinged bracket having a finger tab attached to the distal end of the bracket.

13. The apparatus of claim 1 further comprising:

a decorative theme plate having front and rear surfaces, the front surface having a display region;

means for releasably attaching the theme plate to the hinged bracket;

whereby the theme plate can be releasably attached to the apparatus for holding a calendar.

14. The apparatus of claim 13 further comprising:

the decorative theme plate being made of a perforated material.

15. The apparatus of claim 13 wherein the means for releasably attaching the theme plate to the hinged bracket comprises:

a magnet being fixedly secured to the theme plate.

16. The apparatus of claim 13 wherein the means for releasably attaching the theme plate to the hinged bracket comprises:

hook and loop fasteners being engaged one to the theme plate and the other to the hinged bracket.

17. The apparatus of claim 13 wherein the means for releasably attaching the theme plate to the hinged bracket comprises:

the rear surface having a tab for engaging the horizontally oriented slot, the tab having a downwardly oriented wedge shape, the receiving plate having a vertical portion with a downwardly directed wedge shape for abutting the tab.

18. The apparatus of claim 13 wherein the means for releasably attaching the theme plate to the hinged bracket comprises:

a c-channel having an arcuate spring displaced therein;

a mounting plate having a flange portion and a vertical portion;

a first edge of the flange of the mounting plate being fixedly secured to the back of the theme plate;

a second edge of the flange of the mounting plate being fixedly secured to the vertical portion;

whereby the mounting plate slidingly engages the c-channel.

19. The apparatus of claim 1 further comprising:

a hinge pin, the hinge pin having an upper shoulder portion and a lower portion having a groove wherein the clip is inserted, the shoulder portion being fixedly connected the hinged bracket;

a hinge pin clip;

and a sleeve, the sleeve being fixedly connected to the back plate;

whereby the hinge pin is inserted through the sleeve;

further whereby the hinge pin clip is releasably connected to the pin groove;

further whereby the back plate is hingedly connected to the hinged bracket.

20. An apparatus for holding a calendar comprising:

a back plate, the back plate having a ridge being horizontally oriented near the top of the back plate;

a hinged bracket being hingedly connected to the back plate, the hinged bracket having at least one magnet attached thereto, the magnet being adapted to releasably engage the back plate, the back plate having a metallic portion to coincide with the at least one magnet, the hinged bracket having a finger tab attached to a distal end of the bracket;

a receiving plate being fixedly attached to the hinged bracket and having a horizontally oriented slot;

one or more holes displaced in the back plate wherein fasteners may be used to affix the back plate to a wall;

a decorative theme plate having front and rear surfaces, the front surface having a display region, the rear surface of the theme plate having a tab for engaging the horizontally oriented slot, the tab having a downwardly oriented wedge shape, the receiving plate having a vertical portion with a downwardly directed wedge shape for abutting the tab;

a hinge pin, the hinge pin having an upper shoulder portion and a lower portion having a groove wherein the clip is inserted, the shoulder portion being fixedly connected the hinged bracket;

a hinge pin clip;

and a sleeve, the sleeve being fixedly connected to the back plate;

whereby the hinge pin is inserted through the sleeve;

further whereby the hinge pin clip is releasably connected to the pin groove;

further whereby the back plate is hingedly connected to the hinged bracket.

* * * * *